United States Patent [19]

Oakley

[11] Patent Number: 4,903,345

[45] Date of Patent: Feb. 27, 1990

[54] STOCKINGS WITH CONNECTING CROTCHPIECE

[76] Inventor: Thurman B. Oakley, 321 Coach-Light Trail, Burlington, N.C. 27215

[21] Appl. No.: 271,932

[22] Filed: Nov. 16, 1988

[51] Int. Cl.[4] ..... A41B 9/04

[52] U.S. Cl. ..... 2/240; 2/409; 66/177

[58] Field of Search ..... 2/409, 240, 239; 66/177

[56] References Cited

U.S. PATENT DOCUMENTS

| | | | |
|---|---|---|---|
| 2,062,596 | 12/1936 | Monette | 20/70 |
| 3,466,667 | 9/1969 | Rosner | 2/240 |
| 3,487,473 | 1/1970 | Janhsen | 2/409 X |

FOREIGN PATENT DOCUMENTS

| | | | |
|---|---|---|---|
| 2006251 | 8/1971 | Fed. Rep. of Germany | 2/409 |

*Primary Examiner*—H. Hampton Hunter

*Attorney, Agent, or Firm*—Rhodes, Coats & Bennett

[57] ABSTRACT

A pair of stockings are joined at the inner upper edge to form an integral garment connected by a crotchpiece. The crotchpiece extends between the two upper leg portions after being sewn to a portion of the top edge of each stocking. The stockings are worn under, and supported by, a pair of conventional panties. Additional support comes from a circumferential elastic band formed at the top of each stocking by a unique combination of spandex, nylon and cotton yarns. The band fits snugly around the thigh to prevent the stockings from slipping downwardly.

11 Claims, 1 Drawing Sheet

STOCKINGS WITH CONNECTING CROTCHPIECE

BACKGROUND AND SUMMARY OF THE PRESENT INVENTION

The present invention is related to the field of pantyhose, however, is a garment formed without the conventional knit-in panty. Although the sale and use of pantyhose has dominated the hosiery market for decades, there are many who consider them to be uncomfortable to wear, and even unattractive. Common problems are poor sizing, being uncomfortably hot in summer weather and, from a manufacturing standpoint, being expensive to manufacture in a wide range of sizes and/or styles.

Sizing problems occur because of the almost infinite variety of sizes and shapes of waists and hips, complicated by differing leg lengths. Consequently, in order to avoid having the pantyhose be prohibitively expensive, the predominant trend is to have the hose sized small, medium and large. Only the more expensive brands feature multiple sizes which accomplish a comfortable fit for more people.

With regard to production expense apart from sizing, the formation of the panty is an expensive cost. In most instances, the panty required at least one sewing operation joining the two hip portions (which are knit integrally to the leg) along a center seam.

Recent years have demonstrated a trend in the consumer market toward returning to the use of conventional stockings with separate means of support. There also have been self-supporting thigh-high and knee-high hosiery introduced to the marketplace and have demonstrated some success. However, the self-supporting aspects of these stockings—generally an elasticized yarn knit into the upper portion—has been less than satisfactory, resulting in the hosiery wrinkling and sagging.

The present invention overcomes many of these problems by eliminating the hip or panty portion of the pantyhose, while retaining the crotch portion. A relatively conventional knit-in or sewed-on crotchpiece normally utilized in pantyhose is attached to a portion of the upper periphery of each stocking, therefore actually forming a unitary garment. Alternatively, adjacent points on the top edge of each leg might be sewed together without any crotchpiece.

In use, the stockings are put on the body in the way pantyhose are, but before the conventional lingerie panty, not over the panty. When worn in this way, the crotch portion of the lingerie panty overlies the crotchpiece of the hosiery, helping to support the hosiery.

Each stocking further includes a peripheral or circumferential band around the upper portion thereof, which band includes at least one elasticized yarn, to help support the stocking. The circumferential band generally fits around the upper thing area and stretches snugly around the leg to support the stocking. In the preferred embodiment, the band is formed of a variety of yarns as is fully described below—at least one of the yarns being a spandex yarn.

While there are many advantages obtained by the present invention, one of the primary objectives is the provision of a pantyhose-like garment which eliminates the panty portion while retaining the crotch portion to fit under a conventional panty to support the stockings. A further objective is the provision of a pantyhose-like garment which can be produced more economically in a wide range of sizes because of the elimination of the hip and waise portion of the panty. Other and further advantages and objectives will become apparent as the following detailed description is studied in conjunction with the accompanying drawings:

DETAILED DESCRIPTION OF A PREFERRED EMBODIMENT

Figure 3:
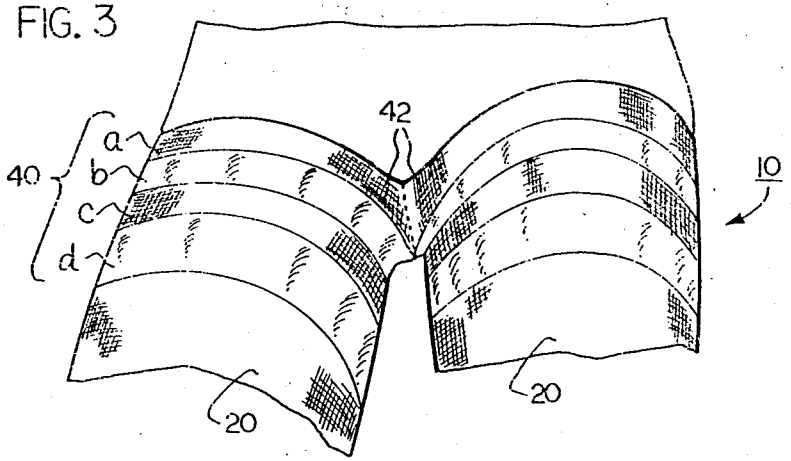
FIG. 3 is a front perspective of the hosiery as worn in FIG. 1, broken away below the thigh, without the lingerie panty thereover.

Looking first at all of the figures, the hosiery 10 of the present invention is shown on and off the body. The garment 10 generally is comprised of a pair of stockings 20 which extend to the upper thigh of the wearer and which are joined together either with or without a gusset-like crotch portion 30 which may be knit into or sewed onto the upper periphery of each stocking.

Basically, the garment 10 is knit according to conventional pantyhose construction with the exception of eliminating the hip and waist portions of the panty, retaining the crotch portion 30, and the addition of a unique circumferential support band 40 around the periphery of each stocking. The support band 40 may be formed in a continuous pattern of a combination of yarns such as the nylon generally used for knitting stockings, combined with spandex or another elasticized yarn. The band 40 functions to aid in supporting the stocking. However, in the preferred embodiment of the band 40 is divided into four segments "a", "b", "c", and "d" as described in detail below.

Figure 1:
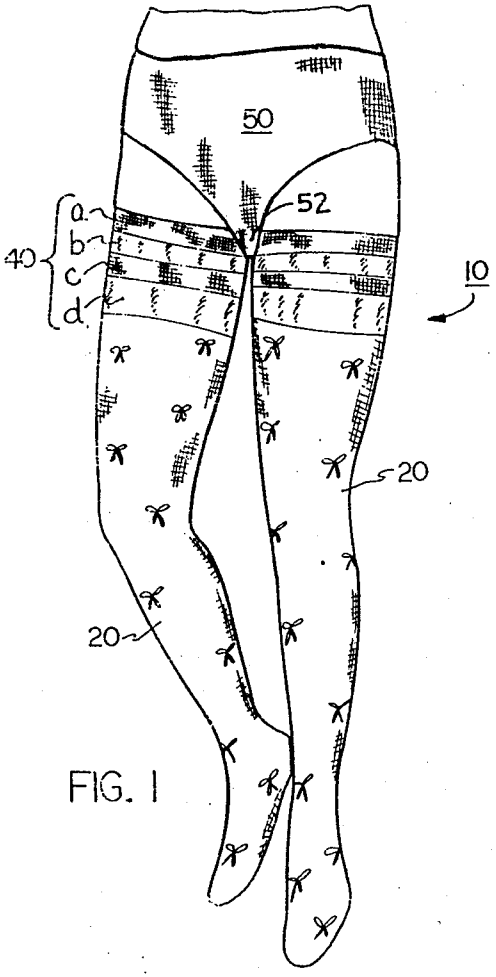
FIG. 1 is a front perspective view of the hosiery on a body worn under the conventional lingerie panty.

Looking next at FIG. 1, the preferred embodiment is shown as it is worn under a conventional lingerie panty 50. The garment 10 is pulled onto the body as are pantyhose, prior to putting on panty 50. When pulled up around the upper thigh, the crotch 30 extends between the legs as if it were a part of a knit-in panty (FIG. 3). The lingerie panty 50 is then put on, the crotchpiece 52 of panty 50 overlying the hosiery crotchpiece 30, thereby helping to support the hosiery.

Figure 2:
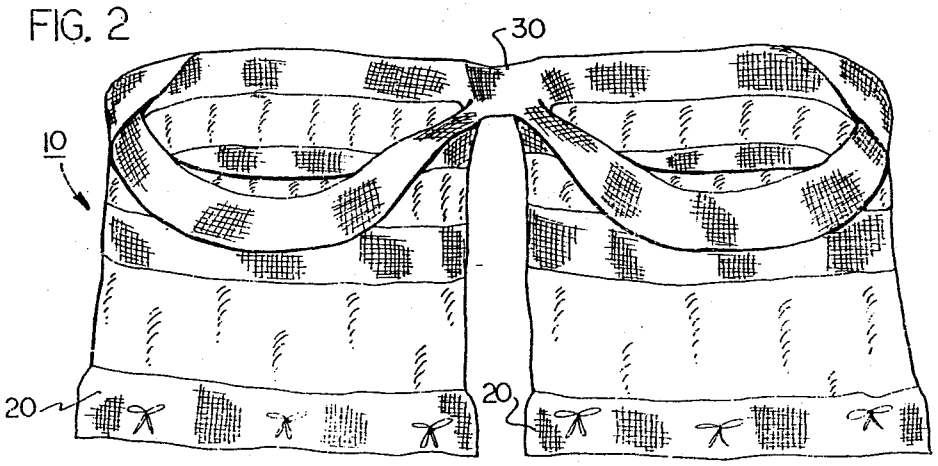
FIG. 2 is a front view of the hosiery, off the body.

As best known in FIG. 2, the crotch 30 is knit integrally, extending from a portion of the peripheral edge of each stocking; specifically the inside edges 42 of support band 40*a*. When knit in the extensions are formed in a prescribed length and width and then joined to the other by a simple straight seam. The crotch 30 may alternatively be a separate sewn-in gusset or patch. In the preferred embodiment the crotch 30 should be formed of cotton yarn or fabric for purposes of hygiene and comfort.

The inner peripheral edges 42 of the stocking support bands are extended during knitting to form the crotch or to receive the separate sewn-in gusset or patch which becomes the crotch 30. According to a prescribed size, the extended edges 42 should be of a length/width sufficient to support the gusset or crotchpiece 30 without undue stress or pulling on the tops of the stockings. Such stress or pulling creates sagging and/or wrinkling of the stockings.

Turning now to the details of the support band 40, the preferred embodiment includes a plurality of courses 40*a*, 40*b*, 40*c* and 40*d*; each series being knitted of a different combination of yarns. For example, at least one series of courses is knitted from a combination of spandex and cotton. The cotton fiber yarn is utilized for comfort—particularly when worn in the summer. The spandex is included, of course, for its elasticity. In some embodiments, it may be desirable to knit the entire support band 40 of spandex for increased support.

Further courses include one series formed of nylon and spandex yarns; and a series formed exclusively of nylon yarns. For example, in FIG. 3, a preferred embodiment would include series 40*a* being formed of spandex yarns and cotton yarns; series 40*b* formed of spandex yarns and nylon yarns; 40*c* formed exclusively of nylon yarn; and 40*d* formed exclusively of spandex yarn. The particular combination of a series of courses provides adequate support for the stocking, but without undue tension being applied consistently around the upper thigh. Each series demonstrates a varying degree of elasticity and therefore fits around the thigh with varying degrees of tension. This unique combination significantly increases the comfort of the stockings while providing adequate support to prevent sagging and wrinkling.

While other and further modifications may become apparent to those skilled in the art, the invention is limited only by the claims below.

What is claimed is:

1. A hosiery garment including a pair of full-length stockings, each stocking having upper thigh and lower leg portions and having a length extending to the upper thigh area; each thigh portion having a support means comprised of a circumferential band knitted around the upper periphery of said thigh portion and terminating on a line substantially horizontal to the crotch of the wearer for supporting said stockings on the leg of the wearer; a crotch member for connecting said pair of stocking at the upper edges of said support means; the upper extent of said crotch member also terminating substantially on said horizontal line; whereby said hosiery garment terminates substantially above a horizontal line extending through the crotch of the wearer and may be worn as a conventional pair of pantyhose extending to the upper thigh area, and with said crotch member worn underneath a conventional separate panty.

2. A garment according to claim 1 wherein said garment is a knitted garment and said support means is comprised of a spandex yarn utilized to form at least a prescribed portion of said band; thereby increasing the stretch capabilities of said band.

3. A garment according to claim 1 wherein said band is formed by knitting together a combination of yarns including a first yarn having a first fiber content, and second yarn having a second fiber content.

4. A garment according to claim 2 wherein said first yarn fiber is cotton and said second yarn fiber is spandex.

5. A garment as in claim 1 wherein said garment is knitted and said band is formed in a plurality of series of courses, each series being made up of courses knit from yarn having a prescribed fiber content and wherein at least one of said series is made up of courses knit from spandex yarn.

6. A garment as in claim 4 wherein said support means is comprised of: a first series made up of courses knit from spandex, and a second series made of courses knit from a combination of spandex and cotton yarns.

7. A garment as in claim 5 and further including a third series made up of courses knit from a combination of spandex and nylon yarns.

8. A garment as in claim 6 further including a fourth series made up of courses knit from nylon yarn.

9. A garment as in claim 7 wherein said circumferential bands include an upper portion forming the terminal edge of each stocking and to which upper portion said crotch member is attached, and a lower portion; said upper portion being formed of second course having spandex and cotton yarns; said lower portion being formed of said first course having spandex yarns; with said third and fourth courses being knitted in between said first and second courses.

10. A garment as in claim 1 wherein said crotch member is knit in as the stockings are formed.

11. A garment as in claim 1 wherein said crotch member is formed separately and sewed between the upper edges of said stockings.

* * * * *